United States Patent [19]

Bar et al.

[11] Patent Number: 4,746,109

[45] Date of Patent: May 24, 1988

[54] APPARATUS FOR ASSEMBLING CONTINUOUS PRINTED FORMS IN STORAGE TRAYS

[75] Inventors: Zakhar Bar, Hicksville; Herbert Weisman, deceased, late of Miller Place, both of N.Y.

[73] Assignee: Bowe Systems & Machinery Corporation, Hicksville, N.Y.

[21] Appl. No.: 745,644

[22] Filed: Jun. 17, 1985 (Under 37 CFR 1.47)

[51] Int. Cl.[4] ..... B65H 45/22

[52] U.S. Cl. ..... 270/95; 198/423; 198/435; 198/444; 250/548; 377/8; 377/53; 209/652

[58] Field of Search ..... 270/54–55, 270/58, 95, 21.1; 198/373, 408, 422, 423, 435, 444, 461; 250/548; 377/8, 53; 209/652

[56] References Cited

U.S. PATENT DOCUMENTS

| | | | |
|---|---|---|---|
| 2,251,306 | 8/1941 | Thompson | 192/84 P |
| 2,629,300 | 2/1953 | Smith | 270/95 X |
| 2,725,002 | 11/1955 | Battersby | 270/95 |
| 3,611,887 | 10/1971 | Shibanuma | 270/95 |
| 4,151,986 | 5/1979 | Kawada | 270/95 |
| 4,439,865 | 3/1984 | Kivuchi et al. | 377/8 |
| 4,601,396 | 7/1986 | Davie | 270/58 X |

*Primary Examiner*—E. H. Eickholt

*Attorney, Agent, or Firm*—Karl F. Ross; Herbert Dubno

[57] ABSTRACT

Continuously printed forms, e.g. checks, are cut from a sheet, sequenced and fed longitudinally and horizontally so that they are overlapped. Trays are moved vertically downwardly and are laterally open so that the overlapped checks are inserted and thereby stacked in the trays. Defective forms can be removed prior to shingling and slip sheets can be inserted to designate locations at which defective forms have been removed.

12 Claims, 6 Drawing Sheets

APPARATUS FOR ASSEMBLING CONTINUOUS PRINTED FORMS IN STORAGE TRAYS

FIELD OF THE INVENTION

Our present invention relates to an apparatus for assembling continuous printed forms in storage trays and, more particularly, to a device for laterally introducing and stacking individual forms which have been printed in a continuous manner in an open-sided tray.

BACKGROUND OF THE INVENTION

Bulk form processing has basically been handled using two methods. Forms either have been printed in a continuous manner and then cut, sequenced and inserted in envelopes, or forms have been individually printed and placed in trays for later stuffing into envelopes. The printing of individual forms is inefficient. At the time forms are placed in envelopes, moreover, it is inefficient to locate and replace defectively printed forms.

It is thus desirable to overcome these deficiencies of using continuously printed forms and storing them in trays.

OBJECTS OF THE INVENTION

An object of our invention is to provide an improved device for the processing of forms which will obviate the aforestated disadvantages.

A further object is to provide a simplified system or apparatus for the handling of continuous printed forms, e.g. checks to be mailed or otherwise distributed.

SUMMARY OF THE INVENTION

These objects are attained in accordance with our invention by a device for taking the forms which are printed, such as checks, in a continuous manner, cutting them from a web where they may be out of sequence in the paper-feed direction, sequencing them and laterally introducing and stacking them in open-sided trays.

The forms with which the invention is concerned are those which have been previously printed in a continuous row, side by side in columns. There thus may be R X S forms comprising S rows and R columns on the sheet material which is processed in accordance with the invention. Typically there are only two columns of forms.

As the forms are printed, the forms are optically scanned to detect any defects. If a defect is found a distinctive mark is applied to the form for later machine detection.

The form sheets are first cut by a conventional cutter into individual forms.

After the forms are cut by the cutter, the individual forms are sequenced by the sequencer in a predetermined order, e.g. based upon their position on the sheet and/or by a reading of indicia on the forms. The forms are preferably sequenced by column and then by row using a sequencer known in the art.

The defect mark is detected by the optical mark reader in the cutter. If a defect mark is found, the defective form is then bypassed to a reject hopper by a divert mechanism. Additionally if a defective form is found a slipsheet is substituted in the sequence to replace the defective form after it has been bypassed. This sheet facilitates identifying the location of the rejected defective form to enable a substitute to be prepared. Slipsheets can also be inserted to separate different consecutive batches of forms or the location of a remade check upon detection of the distinctive mark.

The forms are transported to stacking magazines or trays via a fast/slow conveyor. The input speed of the forms is greater than the output speed causing the forms to overlap in a shingle pattern forming an assembly of individual forms. This facilitates the uniform stacking of the forms in the open-sided tray, the shingled individual forms being laterally inserted into the open-sided tray. The forms can be rectangular and fed in their long directions so as to overlap longitudinally.

The trays are hung on horizontal rods which are attached to a chain conveyor having a drive motor.

The downward path of the trays is electonically controlled and may consist of discrete electronic components and/or at least one microprocessor. The filling position of the vertically descending trays is detected by an electronic photocell. The forms are then fed automatically horizontally into the open side of trays. The tray gradually descends until it is completely filled. The cycle is completed when the filled tray releases itself from the rods and slides onto a table where it activates a switch that electronically shuts off the machine and turns on an indicating light alerting the operator that a completed tray is on the table and an empty tray is to be added to the top rod of the chain conveyor.

The system incorporates additional error indicating lamps for errors in the hopper, transport, feeder and divert. Hopper errors are those associated with the vertical stacking mechanism. Problems in the fast/slow conveyor are referred to as transport errors. Feeder warnings are indicative of a slip-sheet feeder malfunction. Improper operation in the area of the reject hopper is designated as a divert error.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
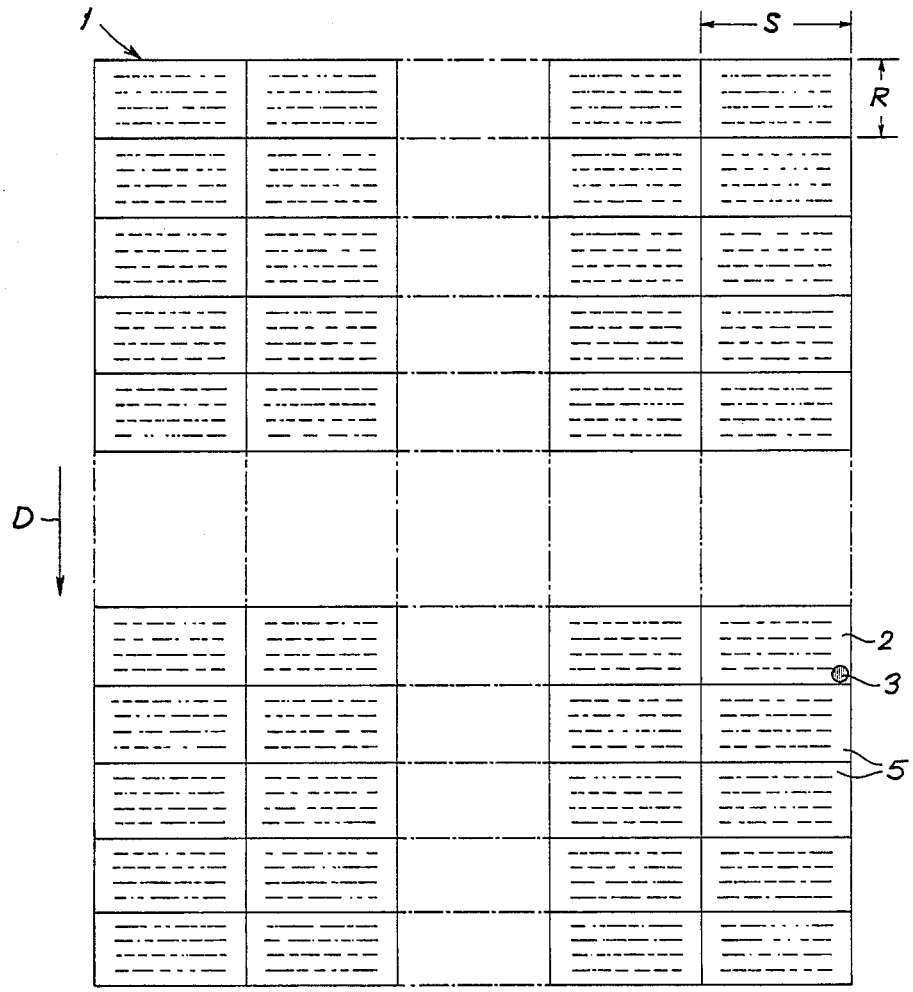
FIG. 1 is a diagrammatic view representing a portion of a sheet of typical forms printed in a continuous manner.

FIG. 1 depicts a web 1 of typical forms 5 (e.g. checks) printed in a continuous manner and displaced in a direction D into a cutter 4. There are R X S forms comprising R columns and S rows. As the forms are being printed they are also optically scanned to detect defectively printed forms. If a form is printed defectively a defect mark is applied to the form during the printing process.

In FIG. 1, the particular form 2 has a defect mark 3 applied to it.

Figure 2:
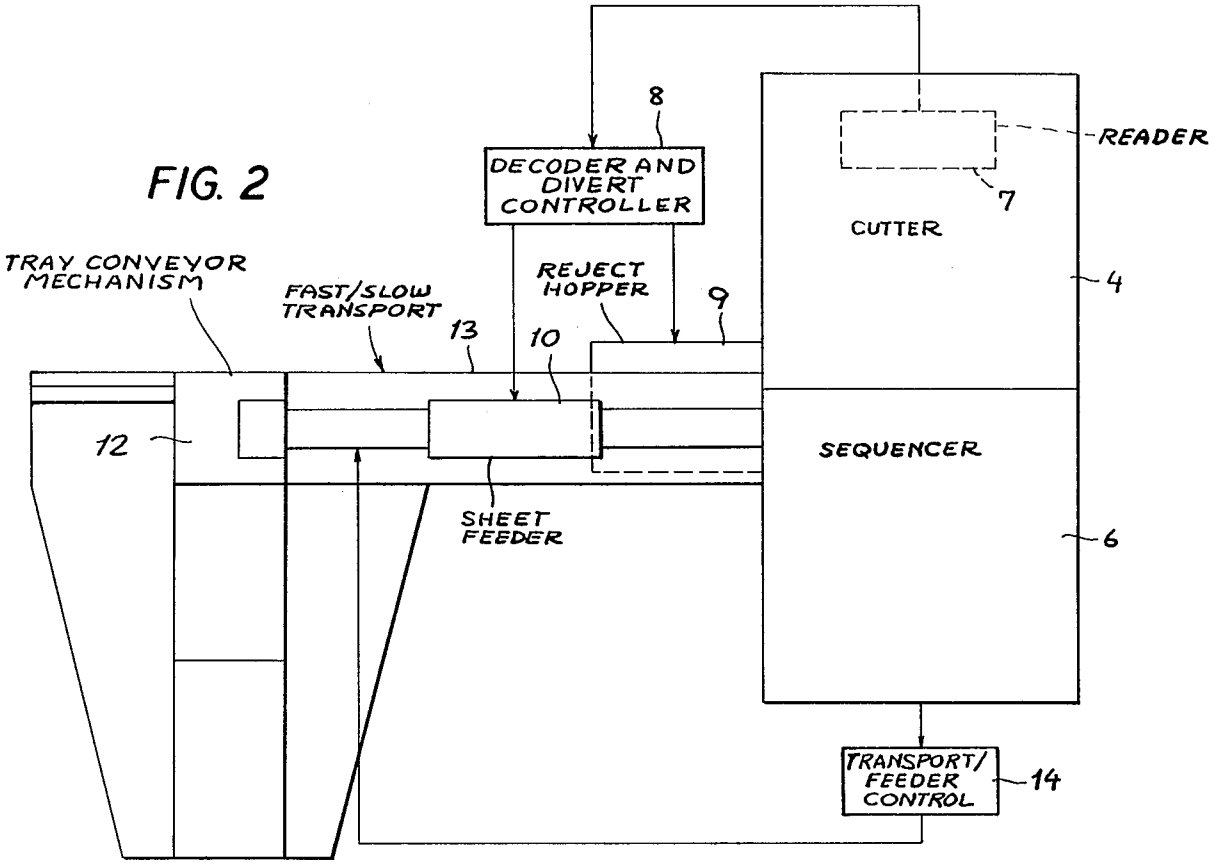
FIG. 2 is a diagrammatic top plan view showing the layout of a continuous form processing and storage system according to the invention.

FIG. 2 illustrates the apparatus of the invention. The web 1 is cut into individual forms 5 by the cutter 4. The individual forms 5 are sequenced for further processing by the sequencer 6 and are scanned by a reader 7 for defective marks 3. The reader 7 is coupled to a decoder and divert controller 8. The controller 8 is also coupled to reject hopper 9 and the sheet feeder 10. Forms 2 which are defective are bypassed to the reject hopper 9. Additionally if a defective form 2 is detected a substituted sheet 11 replaces the defective form 2 and is inserted into the form-feed path by the sheet feeder 10. Slipsheets 11 can also be inserted to separate different consecutive batches of forms or in the location of a remade check upon detection of the distinctive mark 3.

Forms are transported from the sequencer 6 to the stacking mechanism 12 by a fast/slow transport 13. The forms 5 are loaded into a tray in the stacking or tray conveyor mechanism 12.

A transport/feeder control 14 monitors the normal flow of documents from the sequencer 6 to the fast/slow conveyor 13 and also provides a visual indication of transport and slip feeder errors.

Figure 3:
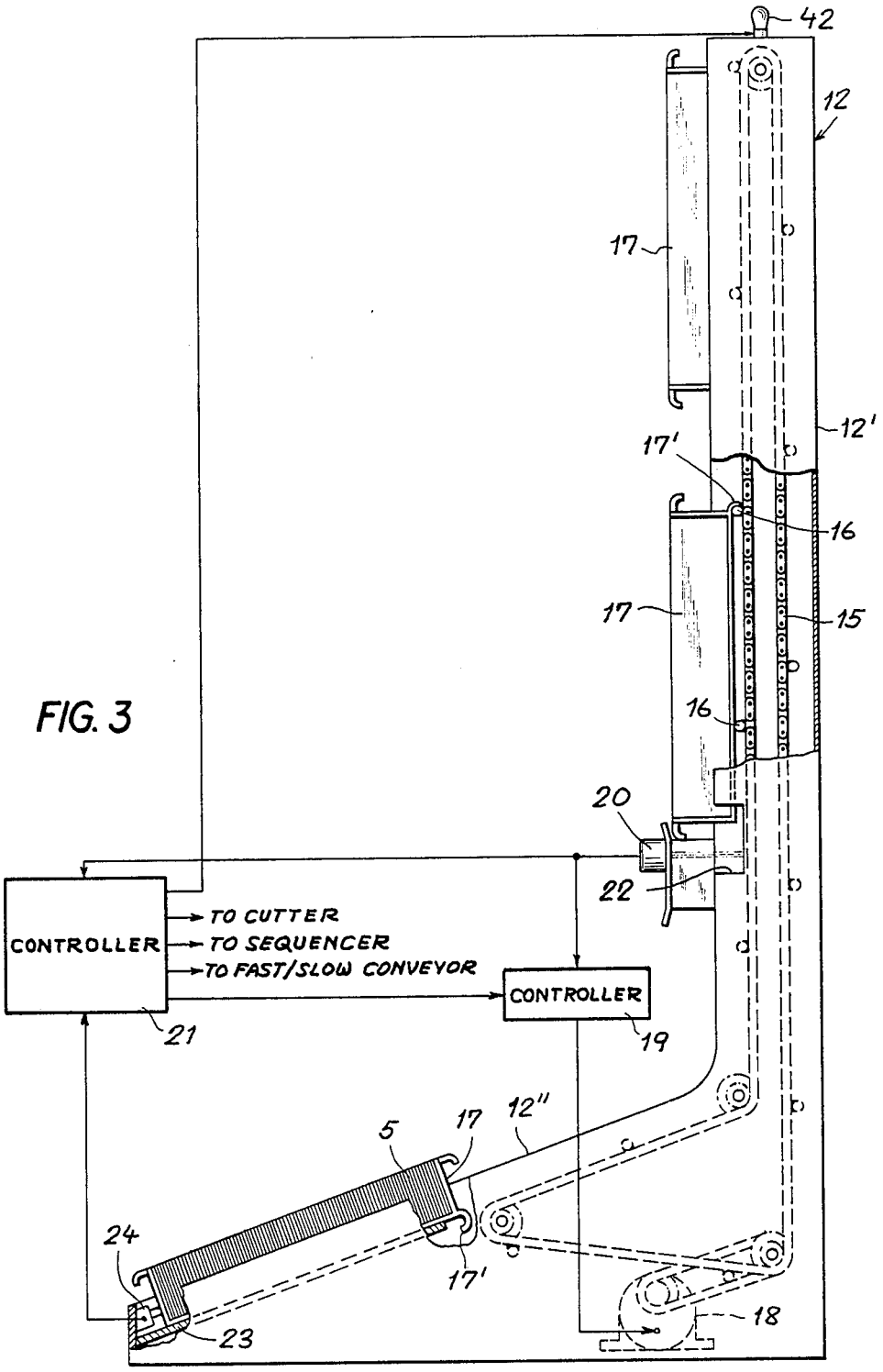
FIG. 3 is a side elevation of the tray conveyor.
Figure 4:
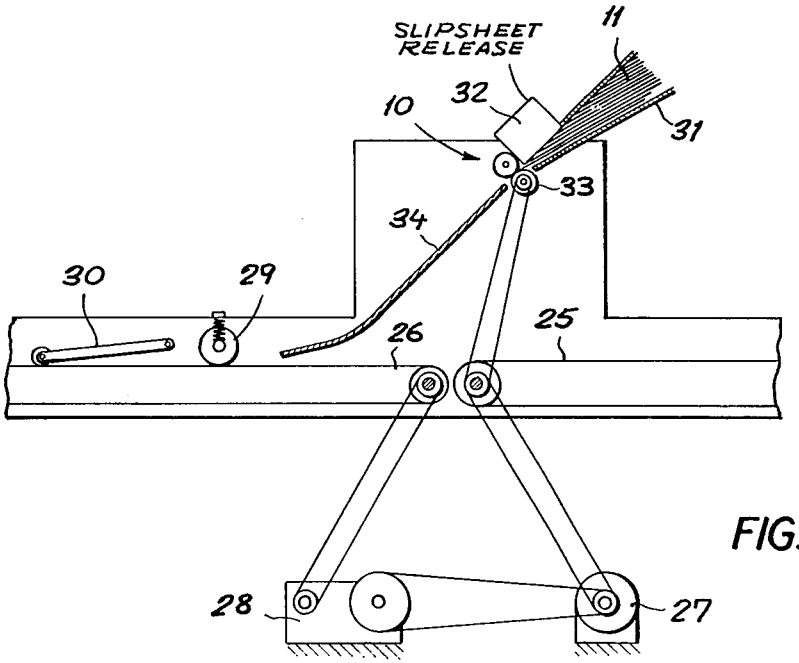
FIG. 4 is a diagrammatic view of the fast/slow conveyor.

FIG. 3 illustrates in detail the tray conveyor mechanism 12, which is formed by an upright portion 12, and a lower inclined portion 12'', an endless chain conveyor 15 traversing the upright portion 12' and a part of the inclined portion 12''. The endless chain conveyor 15 is provided with horizontal support bars 16 from which the trays 17 having one open side can be hung by a hooked flange 17' provided on the back of each tray, the conveyor 15 being driven by a motor 18 in response to signals from a motor controller 19 to which it is connected, the controller 19 in turn being connected to, and receiving signals from, photoelectric eye 20 and a further controller 21.

The photoelectric eye 20 is positioned opposite a cutout 22 formed in a flank of the upright portion 12', through which the forms 5 are fed into the open side of a tray 17 when the eye 20 detects the presence of an empty tray at the level of the cutout 22, the eye 20 also being connected to the controller 21.

The lower portion 12'' of the mechanism is provided with an inclined table 23 upon which a loaded tray is discharged from the chain conveyor 15 and allowed to slide into contact with a microswitch 24, which is connected to the controller 21.

Figure 5:
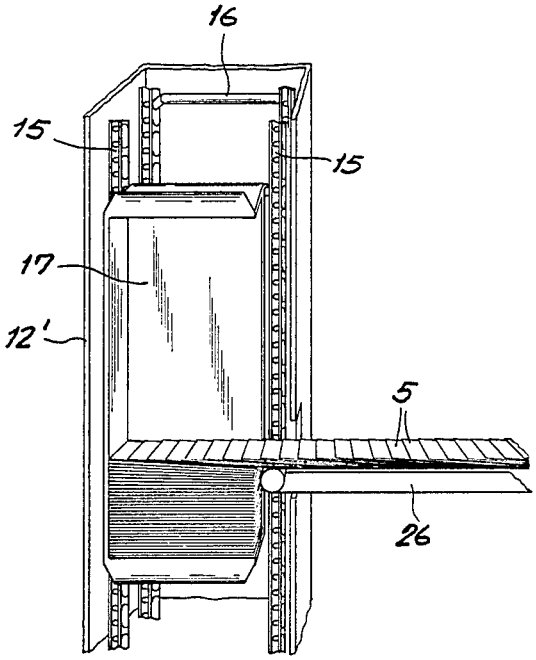
FIG. 5 is a partial perspective view showing forms being stacked in a tray.

The fast/slow conveyor is formed by a fast moving conveyor belt 25 and a slower moving conveyor belt 26 upon which the forms 5 are transported and shingled, the belt 25 being driven directly by a motor 27, and the belt 26 also being driven by the motor 27 but through a speed reducer 28 which drives the belt 26 at a slower speed than belt 25, whereby a form 5 transported along the upper surface of belt 25 at one speed is passed onto the upper surface of belt 26, which is at a slightly lower level, and transported at a slower speed, so that the next form 5 feeding rapidly off the belt 25 is caused to overlap the previous form 5 in a shingling pattern, which is shown in FIG. 5, the shingled pattern of forms being held down and guided on the belt 26 by spring-loaded rollers 29 and pivoted arms 30.

The sheet feeder 10 is associated with the fast/slow conveyor and is formed by a trough 31 which holds the slipsheets 11 and a slipsheet release 32 operated by the decoder 8 and which releases a slipsheet 11 upon a signal from the decoder 8 between a pair of feed rollers 33 driven by a power takeoff from the belt 25, whereby a slipsheet 11 is fed along a guide 34 onto the belt 26 at the same speed as the forms 5 feeding off belt 25, so that the slipsheet 11 can form the overlapping shingle pattern with the forms being transported on belt 26.

Figure 6:
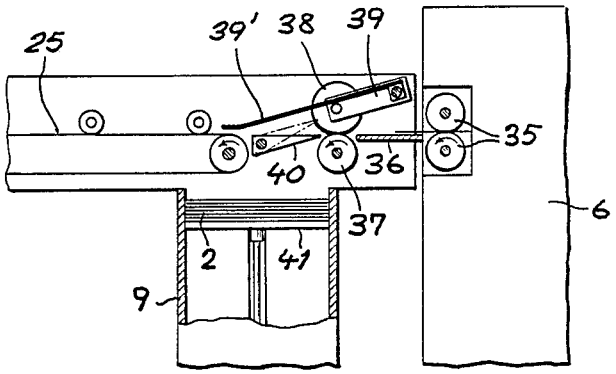
FIG. 6 is a diagrammatic view of the reject hopper and divert mechanism.

FIG. 6 illustrates the reject hopper 9 in which a form is fed from the sequencer 6 by a pair of power rollers 35 onto a support plate 36 which guides the form between another power roller 37 and an idler roller 38 cooperating therewith, the idler roller 38 being carried on a pivoted arm 39 provided with guide fingers 39'. The form is then either guided by pivotable wedge-shaped gates 40 onto the belt 25 or if defective, diverted by the gates 40 which pivot upwardly, as shown in phantom lines, to block the form-feed path in response to a signal from the divert controller 8 into the reject hopper 9, where the defective forms 2 rest on a guided support 41 which descends slowly as the diverted forms 2 collect.

In operation, specifically with reference to FIG. 3, an empty tray 17 is lowered by the chain conveyor 15 until detected by the photoelectric eye 20, which signals controller 19 to stop motor 18 and controller 21 to start cutter 4, sequencer 6 and the fast/slow conveyor, feeding the shingled forms 5 through the cutout 22 and into the tray 17, which slowly descends, e.g. by gravity, as the forms start to collect. Once the tray 17 is filled and clears the beam of the photoelectric eye 20, a signal is sent to motor 18 to resume operating and to the cutter, sequencer and fast/slow conveyor to stop operating until another empty tray 17 is in position to be loaded. Once a loaded tray has descended far enough to be released onto the table 23, the microswitch 24 is activated and the the controller 21 sends shut-off signals to the cutter, sequencer and motor 18, even if an empty tray is in the process of being filled, and a turn-on signal to an indicator light 42, until the full tray is removed from the table 23, releasing the switch 24, whereby the controller 21 signals the system to resume operations and the light 42 to shut off.

What is claimed is:

1. An apparatus for stacking continuously printed individual forms in trays, comprising:

cutting means for cutting a sheet of forms printed in a continuous manner into individual forms;

sequencing means operatively connected to said cutting means for ordering said individual forms in a predetermined sequence;

a plurality of open-sided trays;

transporting means operatively connected to said sequencing means for transporting said individual forms, said transporting means comprising shingling means for causing said individual forms to overlap and forming an assembly of forms for facilitating uniform stacking of said individual forms in said trays, said shingling means being operatively connected to said transporting means for laterally inserting said assembly of forms in said open sided trays; and tray conveying means operatively coupled to said shingling means for vertically positioning one of said trays to receive said assembly of individual forms from said shingling means and for thereafter displacing each tray into a substantially recumbent position upon full loading of said trays.

2. An apparatus as defined in claim 1, further comprising:

detecting means operatively coupled to said sequencing means for detecting forms marked defective;

diverting means in said transporting means for directing said forms marked defective into a reject hopper; and insertion means for substituting sheets in place of said forms marked defective.

3. An apparatus as defined in claim 1 wherein said tray conveying means comprises:

a plurality of horizontal rods operatively connected to said open-sided trays;

an endless element operatively connected to said horizontal rods; and motor means operatively connected to said tray conveying means for driving said endless element.

4. An apparatus as defined in claim 3 wherein said tray conveying means further comprises:

control means for determining when one of said open-sided trays has been completely loaded, and upon one of said open-sided trays being completely loaded activating annunciating means for initiating annunciating signals and for stopping said cutting means said sequencing means, said transporting means and said conveying means.

5. An apparatus as defined in claim 4 wherein said control means comprises:

switching means operatively connected to said conveying means for determining when one of said trays is completely loaded; and a first control circuit coupled to said switching means, coupled to said motor means, coupled to said annunciating means, coupled to said cutting means, coupled to said sequencing means, and coupled to said transporting means for detection by said switching means of one of said trays becoming completely loaded initiates stop signals and signals to energize said annunciating means.

6. An apparatus as defined in claim 5 wherein said tray conveying means further comprises:

an electric eye operatively connected to said conveying means; and a second control circuit coupled to said electric eye and said motor means for vertically positioning one of said trays to receive said assembly of individual forms from said transporting means.

7. An apparatus as defined in claim 6 wherein said second control circuit comprises at least one microprocessor.

8. An apparatus as defined in claim 2 wherein said detecting means further comprises:

electro-optical scanning means for detecting said forms marked defective.

9. An apparatus for laterally stacking individual forms in trays, comprising:

cutting means for cutting forms on a sheet printed in a continuous manner into said individual forms;

sequencing means operatively connected to said cutting means for ordering said individual forms in a predetermined sequence;

a plurality of open-sided trays;

detecting means operatively coupled to said sequencing means for detecting forms marked defective;

transporting means operatively connected to said detecting means and said sequencing means for transporting said individual forms, said transporting means comprising:

bypass means for diverting said forms marked defective detected by said detecting means into a reject hopper; and insertion means for substituting sheets in place of said forms marked defective;

fast/slow conveyor means whereby the ratio of receiving said individual forms is greater than the rate of outputting said forms causing shingling of said individual forms and forming an assembly of forms for facilitating uniform stacking of said individual forms in said trays by laterally inserting said assembly of forms in said open-sided trays; and tray conveying means operatively coupled to said fast/slow conveyor means for vertically positioning one of said trays for receiving said assembly of individual forms from said fast/slow conveyor means and for placing said trays in a substantially horizontal position upon said trays becoming fully loaded, said tray conveying means comprising:

a plurality of horizontal rods operatively connected to said open ended trays, an endless element operatively connected to said horizontal rods, motor means operatively connected to said conveyor ing said endless belt means, switching means operatively connected to said conveying means for determining when one of said trays is completely loaded, and a control circuit coupled to said switching means, said motor means, to a signal light, said cutting means, said sequencing means, and said transporting means for detection by said switching means of one of said trays becoming completely loaded and initiating a stop signal and a signal to energize said lamp.

10. An apparatus as defined in claim 9 wherein said control circuit comprises at least one microprocessor.

11. An apparatus as defined in claim 9 wherein said detecting means comprises electro-optical scanning means for detecting said forms marked defective.

12. An apparatus as defined in claim 1 wherein the said transporting means further comprises:

fast/slow conveyor means for transporting said individual forms from the sequencing means to said open-sided trays wherein the rate of receiving said individual forms is greater than the rate of outputting said forms causing shingling of said individual forms to overlap in a fan-like manner forming an assembly of forms for facilitating uniform stacking of said individual forms in said trays.

* * * * *